US006457216B1

(12) United States Patent
Lo

(10) Patent No.: US 6,457,216 B1
(45) Date of Patent: Oct. 1, 2002

(54) BUCKLE FOR A WRISTWATCH

(75) Inventor: Fong Hay Lo, Tai Wai (HK)

(73) Assignee: Timex Group B.V. (NL)

( * ) Notice: Subject to any disclaimer, the term of this patent is extended or adjusted under 35 U.S.C. 154(b) by 0 days.

(21) Appl. No.: 09/896,609

(22) Filed: Jun. 29, 2001

(51) Int. Cl.[7] ..... A44B 11/06; A44C 5/24
(52) U.S. Cl. ..... 24/265 WS; 24/71 J; 24/68 J
(58) Field of Search ..... 24/265 WS, 71 J, 24/68 J, 265 BC, 265 EC

(56) References Cited

U.S. PATENT DOCUMENTS 5,305,503 A * 4/1994 Yamagata ..... 24/68 J
5,485,659 A * 1/1996 Kashilie et al. ..... 24/71 J
5,787,554 A * 8/1998 Hashimoto ..... 24/68 J
6,023,816 A * 2/2000 Okada et al. ..... 24/71 J

* cited by examiner

*Primary Examiner*—Robert J. Sandy
(74) *Attorney, Agent, or Firm*—Carmody & Torrance LLP

(57) ABSTRACT

A buckle for a watchband comprising a first arm having a first end and a second end, wherein the first end of the first arm is hingedly coupleable to first watchband portion; and a latch, the latch extending from a surface of the first arm; a second arm having a first end and a second end, wherein the first end of the second arm is hingedly coupled to the second end of the first arm, the second arm further having an aperture sized to permit the latch to pass therethrough when the first arm is rotated into a "surface to surface" alignment with the second arm; a shell, the shell being hingedly coupled to the second end of the second arm and hingedly coupleable to a second watchband portion; and a latching mechanism, coupled to the shell, wherein the latching mechanism comprises a backing plate having an aperture sized to permit the latch to pass therethrough; a locking plate, coupled to the backing plate and biased relative thereto, for engaging and latching the latch when the latch is passed through the aperture in the backing plate; wherein the locking plate is moveable in a engaging direction to engage and latch the latch within the latching mechanism and further, wherein the locking plate is moveable in a direction opposite the engaging direction to permit the latch to be delatched from the latching mechanism. In this way, the delatching of the latch from the latching mechanism permits at least the first end of the first arm to be moved in a direction away from the shell.

24 Claims, 5 Drawing Sheets

BUCKLE FOR A WRISTWATCH

BACKGROUND OF THE INVENTION

The present invention relates generally to wristwatches and in particular, to an improved construction of a wristwatch buckle that more reliably secures a wristwatch to a wrist.

Wristwatch foldover buckles are well known in the art. Most typically, such foldover buckles are used in connection with wristwatches that utilize a metal wriststrap. A metal foldover buckle most cosmetically and aesthetically integrates with such a particular style of wristwatch strap. However of course, as with the present invention, using a metal wriststrap is by way of example and not limitation.

FIG. 1 illustrates a conventional foldover buckle, generally indicated at 1. Details of such a buckle will be omitted herein for brevity, as the function, construction and design thereof should be well known to someone skilled in the art. However, for purposes of identifying at least one significant distinction between the state of the art foldover metal buckles and the present invention, the following is set forth. Namely, foldover buckle 1 utilizes a "C-shaped" catch 2. When arms 3 and 4 of buckle i are folded over for closure within shell 5 (see discussion below for detailed understanding of how a foldover buckle can be closed), "C-shaped" catch 2 will engage and "snap" onto the end of arm 4 which itself is hingedly coupled to shell 5 about a spring bar 6 which itself is the pivot point about which arm 4 rotates relative to shell 5.

Undesirably, there are times when a banging or simple shaking of buckle 1, when incorporated into a wristwatch, can cause catch 2 to unhook from the end of arm 4. In this situation, buckle 1 will move towards the open position illustrated in FIG. 1. The undesirable result is that the wristwatch may drop off the wrist or merely, but still inconveniently, catch 2 may need to be "reshaped" onto the end of arm 4. That is, if catch 2 becomes disengaged with the end of arm 4 at the inopportune moment, there is the possibility that the wristwatch my slide or otherwise fall off the person's wrist thereby becoming broken or lost.

Accordingly, an improved foldover buckle construction for more reliably securing a wristwatch to a wrist is desired. The present invention overcomes the aforementioned deficiencies and provides the objectives and advantages set forth below.

OBJECTS AND SUMMARY OF THE INVENTION

Therefore, it is an object of the present invention to provide an improved foldover buckle for a wristwatch.

It is another object of the present invention to provide an improved foldover buckle that can be more reliably secured so as to more reliably secure a wristwatch to a user's wrist.

Still other objects and advantages of the invention will in part be obvious and will in part be apparent from the specification.

The invention accordingly comprises the features of construction, combination of elements and arrangement of parts that will be exemplified in the disclosure hereinafter set forth, and the scope of the invention will be indicated in the claims.

Generally speaking, the present invention is directed to an improved buckle for a watchband. In a preferred embodiment, the buckle comprises a first arm having a first end and a second end, wherein the first end of the first arm is hingedly coupleable to first watchband portion; and a latch, the latch extending from a surface of the first arm; a second arm having a first end and a second end, wherein the first end of the second arm is hingedly coupled to the second end of the first arm, the second arm further having an aperture sized to permit the latch to pass therethrough when the first arm is rotated into a "surface to surface" alignment with the second arm; a shell, the shell being hingedly coupled to the second end of the second arm and hingedly coupleable to a second watchband portion; and a latching mechanism, coupled to the shell, in which the latching mechanism preferably comprises a backing plate having an aperture sized to permit the latch to pass therethrough; a locking plate, coupled to the backing plate and biased relative thereto, for engaging and latching the latch when the latch is passed through the aperture in the backing plate. Constructed in this manner, the locking plate is moveable in a engaging direction to engage and latch the latch within the latching mechanism and is moveable in a direction opposite the engaging direction to permit the latch to be delatched from the latching mechanism, whereby the delatching of the latch from the latching mechanism permits at least the first end of the first arm to be moved in a direction away from the shell.

In a particular embodiment, the latch comprises a shaft and a head, and the locking plate includes an aperture sized to permit the head of the latch to pass therethrough, the locking plate further comprising a finger for engaging the head of the latch when the head of the latch is passed through the aperture in the locking plate. In a preferred construction, the locking plate is rotatably mounted to the backing plate. A spring preferably biases the locking plate relative to the backing plate and exerts a spring force upon the locking plate so as to bias the locking plate in the engaging direction.

A wristwatch comprising the aforementioned buckle is also provided herein.

BRIEF DESCRIPTION OF THE DRAWINGS

For a fuller understanding of the invention, reference is made to the following description taken in connection with the accompanying drawings, in which.

Identically labeled elements appearing in different ones of the above-described figures refer to the same elements but may not be referenced in the description for all figures.

DETAILED DESCRIPTION OF THE PREFERRED EMBODIMENTS

Reference will now be made to the figures wherein a foldover buckle including a latching mechanism, and a wristwatch incorporating at least the foregoing, all as constructed in accordance with the present invention, is disclosed. Reference to the particular figures where appropriate will be set forth.

Figure 2:
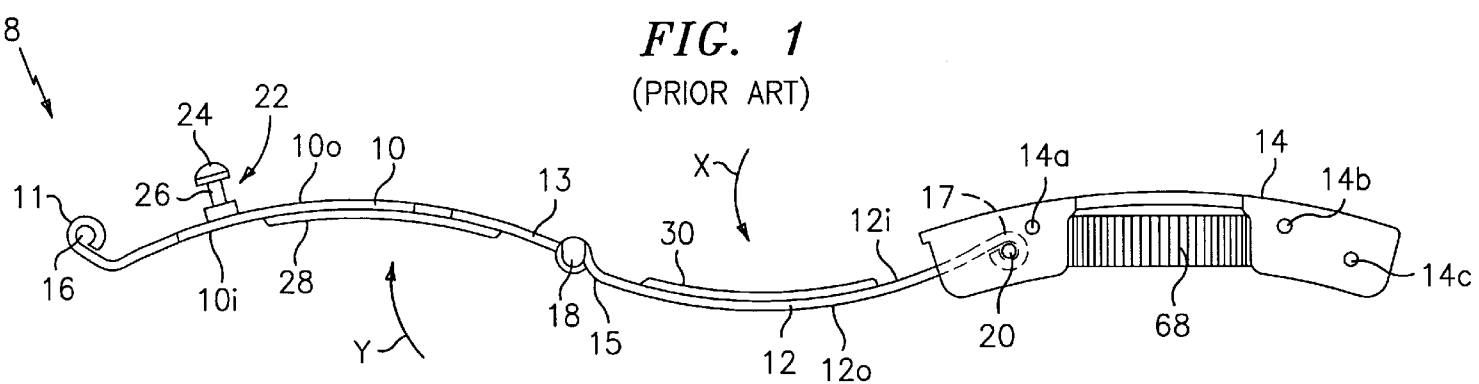
FIG. 2 is a side elevational view of a foldover buckle constructed in accordance with the present invention.
Figure 3:
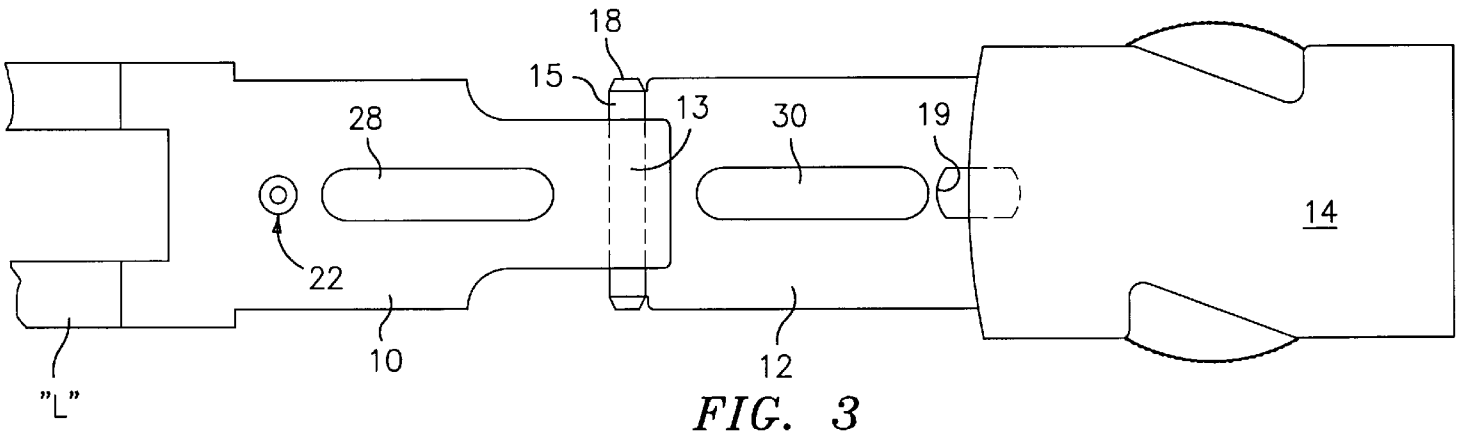
FIG. 3 is a top plan view of the foldover buckle illustrated in FIG. 2.
Figure 9:
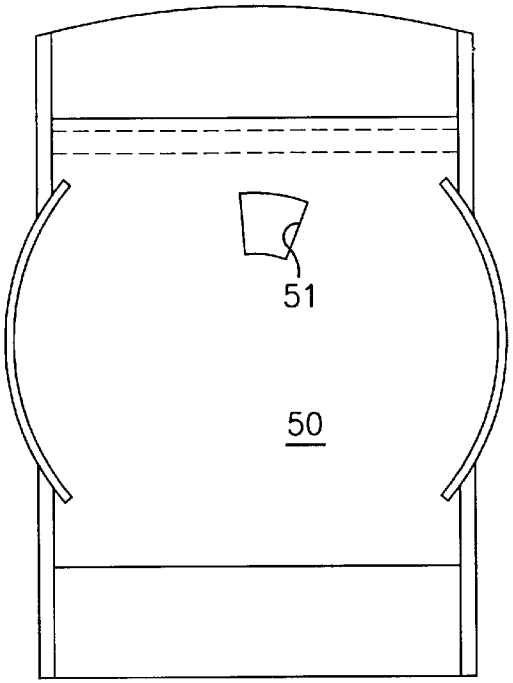
FIG. 9 is a bottom plan view of FIG. 4.
Figure 4:
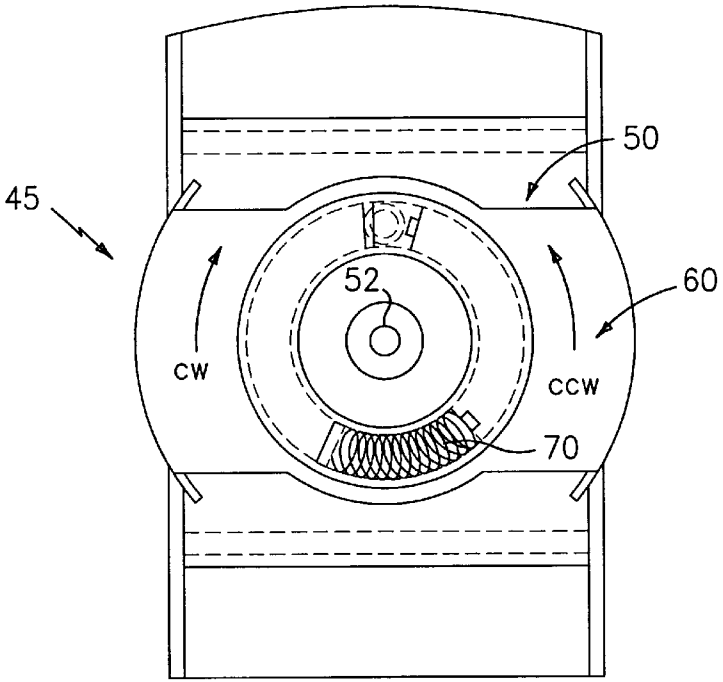
FIG. 4 is a top plan view of a portion of the foldover buckle constructed in accordance with the present invention, in which a locking plate is illustrated in the foreground with a backing plate therebehind and the spring being clearly illustrated.

In accordance therewith and generally speaking, reference is first made to FIGS. 2 and 3 wherein a foldover buckle, generally indicated at 8, constructed in accordance with the present invention, is disclosed. In particular, illustrated in FIGS. 2 and 3 is a first arm 10, a second arm 12 and a shell 14. First arm 10 has a first end 11 and a second end 13, wherein first end 11 of first arm 10 is hingedly coupleable to first watchband portion (an exemplary link "L" which would be understood to be preferably linked to a plurality of similar links (see FIG. 11)). A latch, generally indicated at 22, the function of which will be explained below, can be seen to extend from a surface of first arm 10. In a preferred embodiment, latch 22 can be riveted, welded, soldered or attached to first arm 10 in any number of ways, all within the purview of one skilled in the art.

Figure 11:
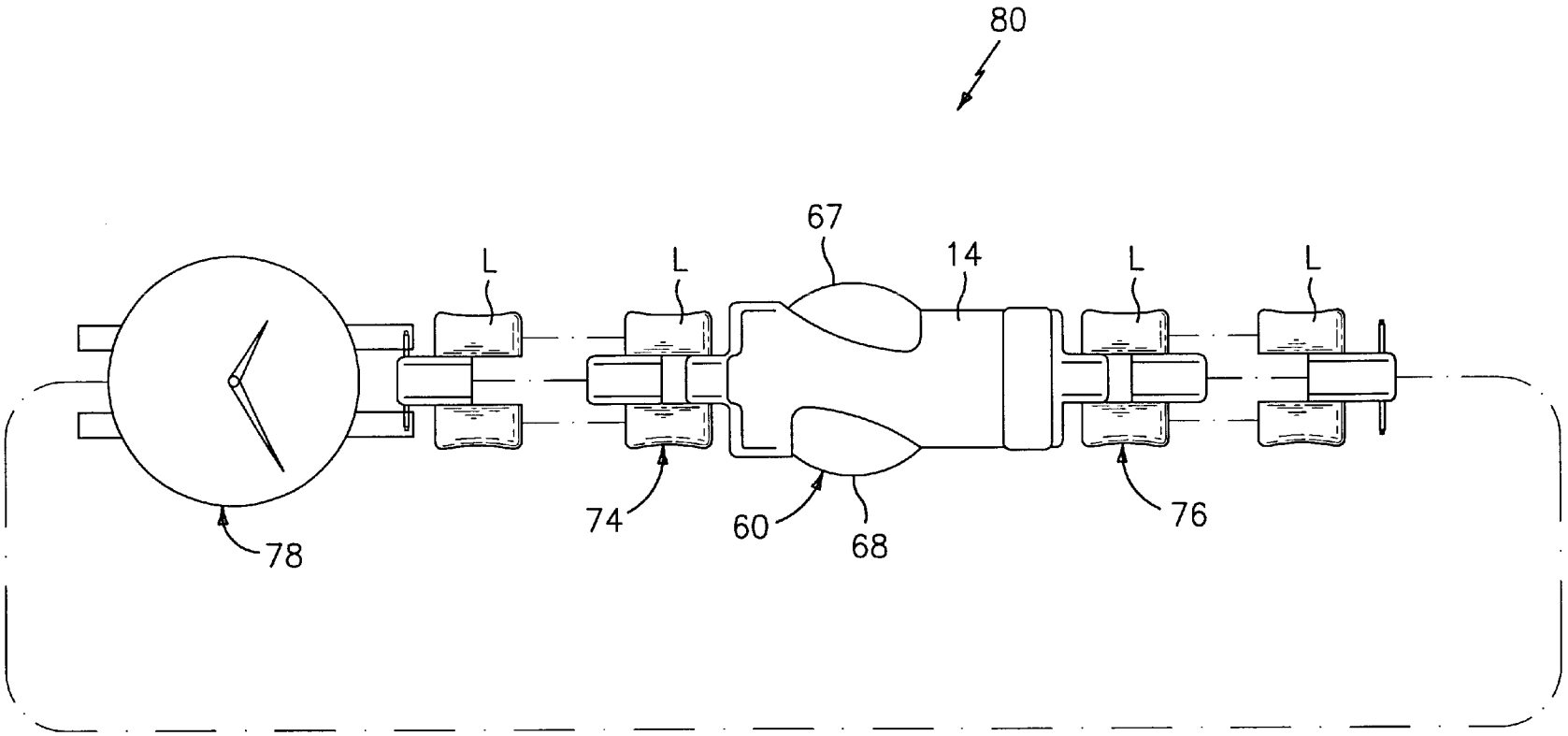
FIG. 11 is a top plan view of a wristwatch comprising a buckle constructed in accordance with the present invention.

A second arm 12, itself having a first end 15 and a second end 17, is hingedly coupled to first arm 10 by the coupling of first end 15 of second arm 12 to second end 13 of first arm 10. The hinge therebetween most preferably includes a pin 18. For reasons that will become clear below, second arm 12 includes an aperture 19 sized to permit latch 22 to pass therethrough when first arm 10 is rotated into a "surface to surface" alignment with second arm 12. A shell 14 is hingedly coupled to second end 17 of second arm 12. When fully constructed as part of a wristwatch, shell 14 will also be hingedly coupled to a second watchband portion (FIG. 11). Aperture 14*c*, with a similar aperture also being on the nonviewable side of shell 14 in FIG. 2, is sized for the springbar of such a second watchband portion.

For purposes of better appreciating the construction and function of the latching mechanism described in greater detail below, an understanding of the relative movement of arms 10 and 12 will first be explained. Specifically, as with conventional foldover buckles, first arm 10 is arcuate so as to define an inner surface 10*i* and an outer surface 10*o*. As is clear, latch 22 extends outwardly from outer surface 10*o*. Similarly, second arm 12 is arcuate so as to define an inner surface 12*i* and an outer surface 12*o*. In the preferred embodiment, second arm 12 is hingedly coupled proximate an end of shell 14. As can be seen in the side surfaces of shell 14, apertures appear as in conventional shells of foldover buckles. These apertures receive springbars or pins, similar to pin 20, therethrough. In this way, along with removing links such as one or more links "L", the watchband can be shortened or lengthened. This should be clear to one skilled in the art. In order for arms 10 and 12 to be in what has been coined herein as "surface to surface" alignment, the following occurs when the buckle 8 moves towards its locked position (FIG. 2 illustrates the opened position).

Figure 1:
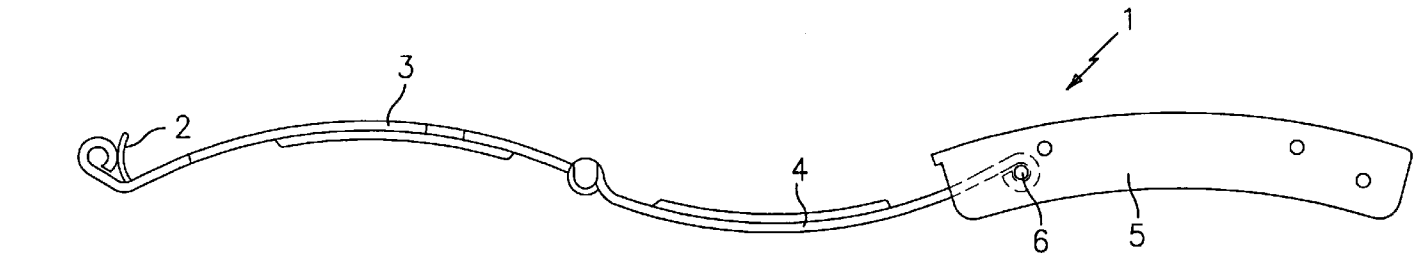
FIG. 1 (PRIOR ART)
FIG. 1 is a side elevational view of a foldover buckle constructed in accordance with the prior art.

Namely, first end 15 of second arm 12 is rotated in the direction indicated by arrow "x" in FIG. 2 relative to second end 17 of second arm 12 which remains hinged to shell 14, while first end 11 of first arm 10 is rotated in the direction indicated by arrow "y" (FIG. 1) relative to first end 15 of second arm 12 which remains hinged to second end 13 of first arm 10. This results in the outer surface 12*o* of second arm 12 to rotate in direction "x" towards shell 14 (see FIG. 7), the outer surface 10*o* of first arm 10 to move in the direction "y" towards and align with inner surface 12*i* of second arm 12, and latch 22 to move towards and pass through aperture 19 in second arm 12 as latch 19 moves towards shell 14. In this way, arms 10 and 12 are in "surface to surface" alignment (see FIG. 7). A raised channel 28 and a corresponding recessed channel 30 may be provided in arms 10 and 12 (or visa versa), respectively, to assist in maintaining a secured "surface to surface" alignment. These channels are known the art and immaterial to the present invention.

Reference is now made to FIGS. 4–10 in connection with the following for an understanding of the latching mechanism, generally indicated at 45, constructed in accordance with the present invention. In particular, the three element construction of latching mechanism 45 comprises a backing plate, generally indicated at 50; a locking plate, generally indicated at 60, and a biasing member 70, in the preferred embodiment biasing member being a spring. It is only a matter of convenience that latch 22 is not disclosed in connection with latching mechanism 45, as latch 22 may of course be considered part of latching mechanism 45.

Backing plate 50 includes an aperture 51 sized to permit latch 22 to pass therethrough. Backing plate 50 includes folded over grasping members for rotatably holding springbars 46 and 47. The proper bending of backing plate 50 can form the properly dimensioned grasping members. Backing plate 50 is coupled to shell 14 by the insertion of springbars 46 and 47 in respective apertures 14*a* and 14*c* (FIG. 2). Locking plate 60 is coupled to the backing plate via a center tab 52 on backing plate 50. Locking plate 60 engages and latches latch 22 when latch 22 is passed through aperture 51 in backing plate 50. Locking plate 60 is biased relative to backing plate 50 by use of biasing member 70. As will be explained below, locking plate 60 is moveable in a engaging direction (see arrow "ccw" in FIG. 4) to engage and latch 22 within latching mechanism 45 and further is moveable in a direction opposite the engaging direction (see arrow "cw" in FIG. 4) to permit latch 22 to be delatched from latching mechanism 45. As will be shortly understood, the delatching of latch 22 from latching mechanism 45 permits at least first end 11 of first arm 10 to be moved in a direction away from shell 14 towards an open position (FIG. 2).

Latch 22 comprises a shaft 26 and a head 24 such that head 24 preferably has a greater width than shaft 26. Of course a notch in latch 22 will provide the operable function and will delineate a head and shaft as disclosed herein.

Locking plate 60 also includes an aperture 61 sized to permit at least head 24 of latch 22 to pass therethrough. Locking plate 60 further comprising a finger 62 that may extend slightly into aperture 61 for engaging head 24 of latch 22 when head 24 of latch 22 is passed through aperture 61in the locking plate. Finger 62 may also be bent slightly in a direction out of the paper as viewed in FIG. 8.

As can be seen, locking plate 60 is preferably rotatably mounted to backing plate 50 (as it is mounted on tab 52 of backing plate 50). In this way, when locking plate 60 rotates in the direction opposite the engaging direction (i.e. when it rotates in direction "cw"), head 24 of latch 22 is passable by finger 62 of locking plate 60, and when locking plate 60 rotates back in the engaging direction (i.e. in direction "ccw"), finger 62 engages head 24 of latch 22 thereby latching latch 22 in latching mechanism 45.

It should be pointed out that other constructions are contemplated herein, and the claims are intended to cover such alternatives. As one example, it should now be understood that locking plate 60 may be a "push plate" relative to locking plate 50. That is, locking plate 60 need not be rotatably mounted on backing plate 50 but rather only spring mounted on so that a pushing action latches and delatches latch 22 from an equivalent locking plate. The push plate would be spring biased relative to the equivalent backing plate.

In the preferred embodiment, backing plate 50 comprises a stopper 53 that will extend through aperture 61 in locking plate 60 (i.e. out of the paper as viewed in FIG. 6) when locking plate 60 is mounted on backing plate 50. Stopper 53 hits an edge "e" of aperture 61 and prevents the unnecessary overrotation of locking plate 60 in the direction opposite the engaging direction (i.e. in the "cw" direction) and prevents an overbiasing of locking plate 60 relative to backing plate 50. That is, spring 70 should not get overly compressed.

That is, latching mechanism 45 comprises spring 70 to bias locking plate 60 relative to backing plate 50. The spring force upon locking plate 60 biases locking plate 60 in the engaging direction ("ccw" direction). To this end, locking plate 60 preferably comprises a second aperture 63 therethrough and a tab 64 proximate an edge of aperture 63 while backing plate 50 comprises a tab 54 extending through aperture 63, again, when plate 60 is mounted on backing plate 50. In this way, spring 70 is disposed intermediate tab 54 of backing plate 50 and tab 64 of locking plate 60 so as to bias locking plate 60 in the ("ccw") engaging direction. Tab 54 may be formed by bending back a cut-out section in backing plate 50 (note aperture 55 formed thereby in FIGS. 6, 10). It should be understood that tabs 54 and 64 should be seen to be coming out of the page in FIG. 5. Also, it should be understood that a channel 65 is formed in locking plate 60 (note consistency between FIGS. 4, 7, 8).

Figure 7:
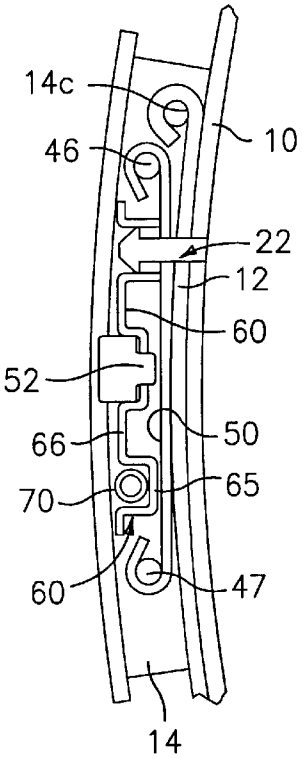
FIG. 7 is a cross-sectional view of the buckle constructed in accordance with the present invention.
Figure 6:
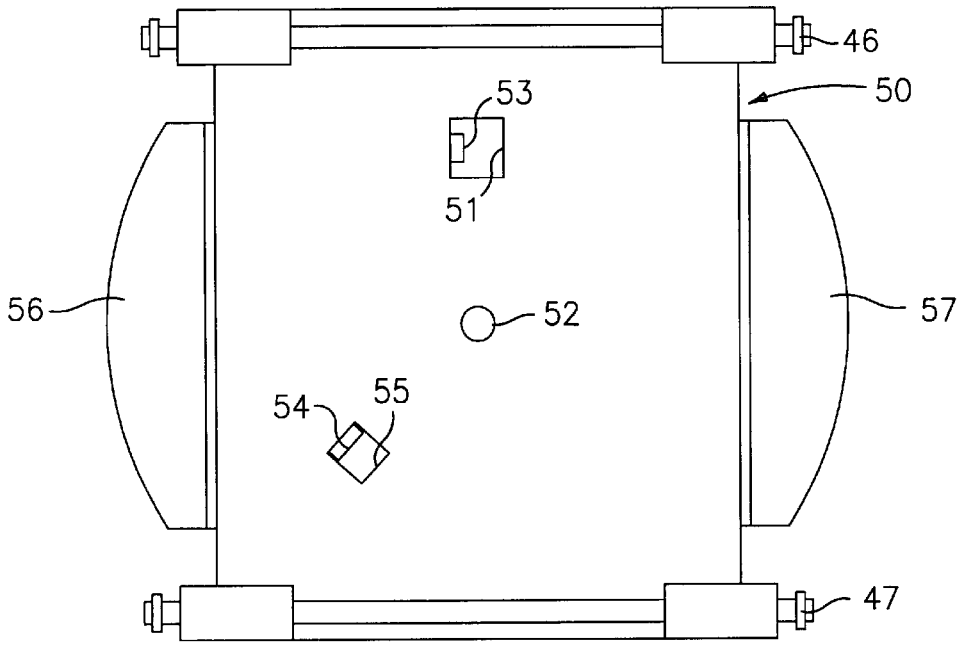
FIG. 6 is a top plan view of the backing plate constructed in accordance with the present invention.
Figure 5:
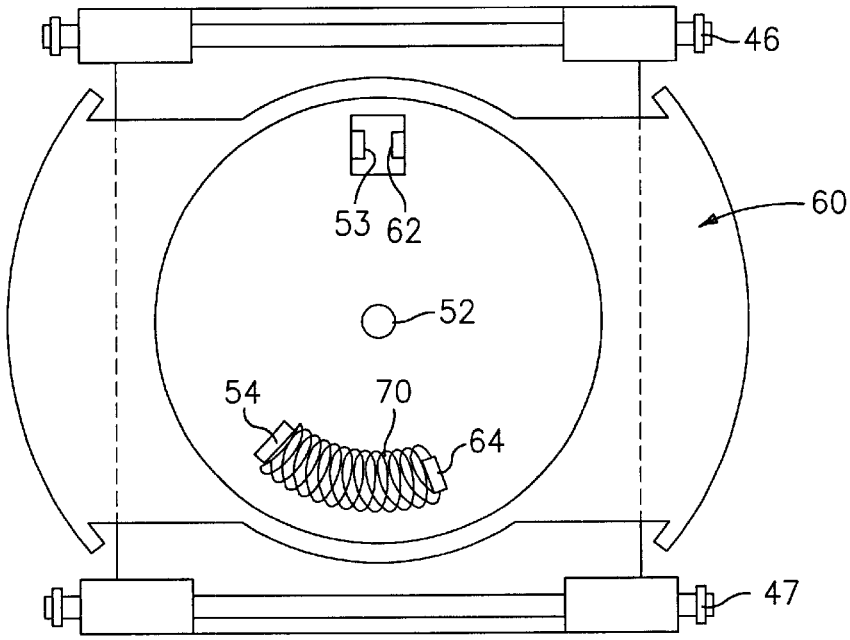
FIG. 5 is another top plan view of a portion of the foldover buckle constructed in accordance with the present invention, again with the locking plate being illustrated in the foreground and the backing plate therebehind, along with other details for a fuller understanding of the present invention.
Figure 8:
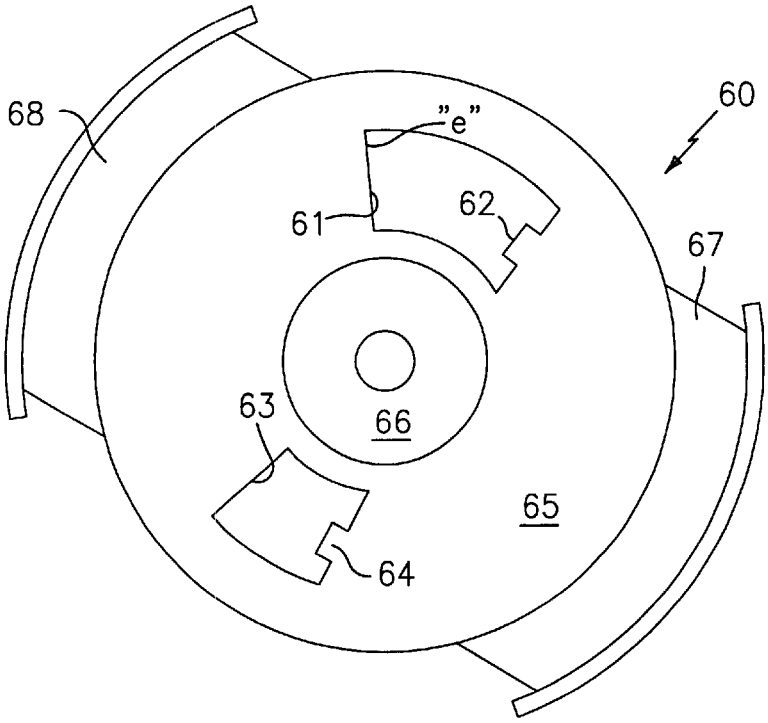
FIG. 8 is a perspective view of the locking plate illustrated in FIG. 4.
Figure 10:
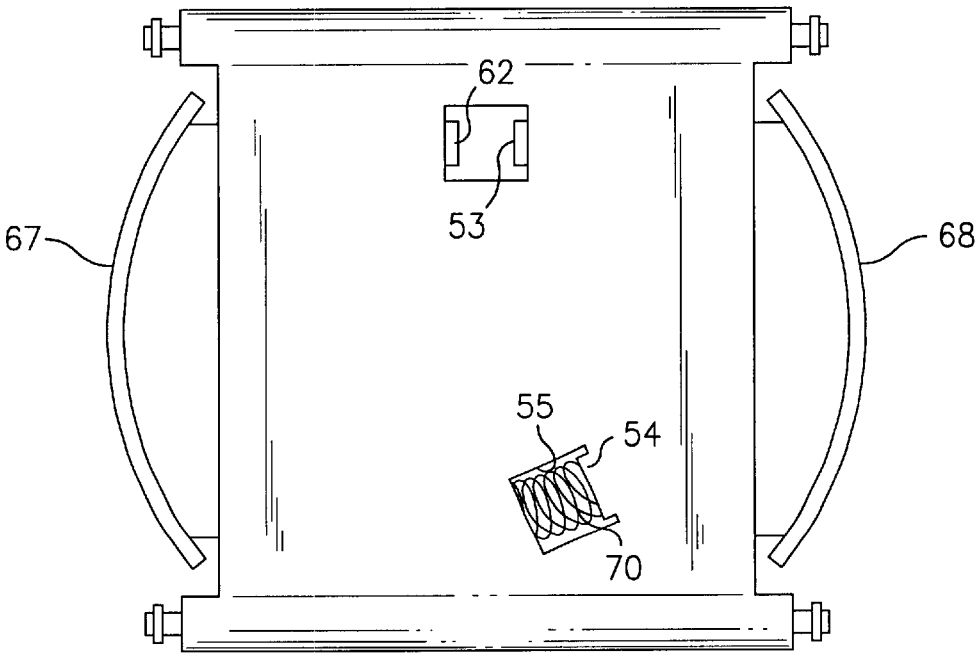
FIG. 10 is a bottom plan view of FIG. 5.

As illustrated in FIG. 7, among others, locking plate 60 is intermediate backing plate 50 and the internal cavity of shell 14.

To facilitate the rotation of locking, plate 60, integrally formed wings 67, 68 extending outwardly therefrom are provided. Wings 67, 68 preferably include knurled outer surfaces and extend sufficiently outwardly from the sides of backing plate 50 sufficient for engagement by a user's fingers. In this way, when head 24 of latch 22 is engaged by finger 62 of locking plate 60, the rotation of locking plate 60 by the wings 67, 68 thereof in a ("cw") direction opposite the ("ccw") engaging direction causes locking plate 60 to rotate causing finger 62 to disengage from latch 22. Latch 22 may then be removed from latching mechanism 45. Backing plate 50 may comprise integrally formed sides 56, 57 that extend outwardly therefrom almost as far outwardly as wings 67, 68. This will provide added stability to locking plate 60.

As set forth above, backing plate 50 comprises a first end for retaining spring bar 46 and a second end for retaining a second spring bar 47. Backing plate 50 is coupled to shell 14 by the securing of first and second spring bars 46 and 47 in apertures 14*a* and 14*c*, respectively, and their respective counterpart apertures (not shown) on the other side of shell 14.

Reference is once again made to FIG. 10 so as to ensure a complete understanding of the construction of the present invention. In particular, shell 14 with latching mechanism (not shown since it is on the underside of shell 14) is shown. Also shown are two separate watchstrap portions 74 and 76 comprising a plurality of links "L." It should be understood that there will be more links "L" in each portion 74 and 76 so as to fit around a user's wrist. Also a watchhead 78 completes a wristwatch 80 constructed in accordance with the present invention. An exemplary watchhead comprising timekeeping functionality and a first end and a second end for respectively being coupled to the ends of the watchstrap portions 74 and 76, is illustrated in U.S. Pat. No. 5,305,291, the disclosure of which is incorporated by reference as if fully set forth herein. In this manner, it should be clear that an entire wristwatch is fully disclosed.

In operation, wristwatch 80 is slipped onto a wrist. Buckle 8 will be in the open position as illustrated in FIG. 2 so as. to get wristwatch 80 around one's wrist. Next, arms 10, 12 are moved into "surface to surface" alignment as disclosed above, causing latch 22 to pass through the aperture in arm 12. As latch 22 passes aperture 51 in backing plate 50, it will contact finger 62 on locking plate 60. A user can, if desired, rotate locking plate in the "cw" direction so as to move finger 62 out of the way to allow head 24 of latch 22 to pass thereby. Alternatively, and more preferably, a user will just put pressure on arm 10 relative to shell 14 so as to forceably cause finger 62 to move out of the way of latch 22 by the force of head 24 against finger 62 as head 24 is sliding by finger 62. In this way, finger 62 is, rotatably moved out of latching engagement with latch 22. Once head 24 passes finger 62, locking plate 60 will "snap" back into latching engagement with latch 22 by way of the biasing of locking plate 60 relative to backing plate 50. A head as shown on latch 22 of FIG. 2 works well for this purpose.

Latch 22 is now releasably locked (or latched) in latching mechanism 45.

To detach latch 22 from latching mechanism 45, a user causes the rotation of locking plate 60 in the "cw" direction by the grabbing and rotation of wings 67, 68. In this way, finger 62 disengages from latch 22. At this time, arm 10 may be pulled away from shell 14 so as to allow buckle 8 to open (FIG. 2). Wristwatch 80 may thereafter be slipped off a user's wrist.

It will thus be seen that the objects set forth above, among those made apparent from. the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense. For example, buckle 8 is preferably made of metal. Watchstrap portions 74 and 76 are also preferably made of metal although other material, such as leather, if desired, may be used.

While the invention has been particularly shown and described with respect to preferred embodiments thereof, it will be understood by those skilled in the art that changes in form and details may be made therein without departing from the scope and spirit of the invention.

What is claimed is:

1. A buckle for a watchband, the buckle comprising:

a first arm having a first end and a second end, wherein the first end of the first arm is hingedly coupleable to a first watchband portion; and a latch, the latch extending from a surface of the first arm;

a second arm having a first end and a second end, wherein the first end of the second arm is hingedly coupled to the second end of the first arm, the second arm further having an aperture sized to permit the latch to pass therethrough when the first arm is rotated into a surface-to-surface alignment with the second arm;

a shell, the shell being hingedly coupled to the second end of the second arm and hingedly coupleable to a second watchband portion; and a latching mechanism, coupled to the shell, wherein the latching mechanism comprises:

a backing plate, having an aperture sized to permit the latch to pass therethrough;

a locking plate, rotatably mounted and positioned intermediate the backing plate and an inner cavity of the shell, the locking plate including an aperture sized to permit a head of the latch to pass therethrough, the locking plate further comprising a finger for engaging the head of the latch when the head of the latch is passed through the aperture in the locking plate;

wherein when the locking plate rotates in an engaging direction the finger engages the head of the latch to latch the latch in the latching mechanism and when the locking plate is rotated in a direction opposite the engaging direction the head of the latch is passable by the finger to permit the latch to be delatched from the latching mechanism;

whereby the delatching of the latch from the latching mechanism permits at least the first end of the first arm to be moved in a direction away from the shell.

2. The buckle as claimed in claim 1, wherein the locking plate includes wings extending outwardly from the backing plate sufficient for engagement by a user's fingers;

whereby when the head of the latch is engaged by the finger of the locking plate, the rotation of the locking plate via the wings thereof in a direction opposite the engaging direction causes the locking plate to rotate in the direction opposite the engaging direction causing the finger to disengage from the latch.

3. The buckle as claimed in claim 1, wherein the locking plate is biased relative to the backing plate.

4. The buckle as claimed in claim 3, wherein the backing plate comprises a stopper, the stopper extending through the aperture in the locking plate, the stopper for preventing unnecessary overrotation of the locking plate in the direction opposite the engaging direction and for preventing overbiasing of the locking plate relative to the backing plate.

5. The buckle as claimed in claim 3, further comprising a spring to bias the locking plate relative to the backing plate;

wherein the spring exerts a spring force upon the locking plate so as to bias the locking plate in the engaging direction.

6. The buckle as claimed in claim 5, wherein the locking plate comprises:

a second aperture therethrough; and a tab proximate an edge of the second aperture; and the backing plate comprises a tab extending through the second aperture;

wherein the spring is disposed intermediate the tab of the backing plate and the tab of the locking plate so as to bias the locking plate in the engaging direction.

7. A buckle for a watchband, the buckle comprising:

a first arm having a first end and a second end, wherein the first end of the first arm is hingedly coupleable to a first watchband portion; and a latch, the latch extending from a surface of the first arm;

a second arm having a first end and a second end, wherein the first end of the second arm is hingedly coupled to the second end of the first arm, the second arm further having an aperture sized to permit the latch to pass therethrough when the first arm is rotated into a surface-to-surface alignment with the second arm;

a shell, the shell being hingedly coupled to the second end of the second arm and hingedly coupleable to a second watchband portion; and a latching mechanism, coupled to the shell, wherein the latching mechanism comprises:

a backing plate, releasably secured to the shell, having an aperture sized to permit the latch to pass therethrough;

a locking plate, for engaging and latching the latch when the latch is passed through the aperture in the backing plate;

wherein the locking plate is moveable in an engaging direction to engage and latch the latch within the latching mechanism and further, wherein the locking plate is moveable in a direction opposite the engaging direction to permit the latch to be delatched from the latching mechanism;

whereby the delatching of the latch from the latching mechanism permits at least the first end of the first arm to be moved in a direction away from the shell.

8. The buckle as claimed in claim 7, wherein the backing plate comprises:

a first end for retaining a first spring bar and a second end for retaining a second spring bar;

wherein the backing plate is releasably secured to the shell by the securing of the first and second spring bars in apertures of the shell.

9. The buckle as claimed in claim 7, wherein the locking plate is intermediate the backing plate and an internal cavity of the shell and wherein the locking plate is retained intermediate the backing plate and the internal cavity of the shell at least in part by the backing plate.

10. The buckle as claimed in claim 9, wherein:

the first arm is arcuate so as to define an inner surface and an outer surface, the latch extending from the outer surface thereof;

the second arm is arcuate so as to define an inner surface and an outer surface; and the second arm is hingedly coupled proximate an end of the shell;

such that the first arm and the second arm are in surface-to-surface alignment and the latch moves towards the latching mechanism for being latched therein when:

the first end of the second arm is rotated in one of a clockwise and counterclockwise direction relative to the second end of the second arm which remains hinged to the shell, and the first end of the first arm is rotated in the other of the counterclockwise or clockwise direction relative the first end of the second arm which remains hinged to the second end of the first arm so as to cause (a) the outer surface of the second arm to rotate towards the latching mechanism (b) the outer surface of the first arm to move towards and align with the inner surface of the second arm and (c) the latch to pass through the aperture in the second arm as it moves towards the backing plate of the latching mechanism.

11. A latching mechanism for a watchband buckle, wherein the buckle couples a first watchband portion to a second watchband portion and wherein an end of each respective watchband portion is coupleable to a watchhead, and wherein the buckle comprises a first arm having a first end and a second end wherein the first end of the first arm is hingedly coupleable to the end of the first watchband portion opposite the end thereof that is coupleable to the watchhead, a second arm having a first end and a second end wherein the first end of the second arm is hingedly coupled to the second end of the first arm and wherein the second arm further has an aperture sized to permit a latch to pass therethrough when the first arm is rotated into a surface-to-surface alignment with the second arm, and a shell that is hingedly coupled to the second end of the second arm and hingedly coupleable to the end of the second watchband portion opposite the end thereof that is coupleable to the watchhead, wherein the latching mechanism, being coupleable to the shell, comprises:

a latch extending from a surface of the first arm;

a backing plate, releasably secured to the shell, having an aperture sized to permit the latch to pass therethrough;

a locking plate for engaging and latching the latch when the latch is passed through the aperture in the backing plate, the locking plate positioned intermediate an inner cavity of the shell and the backing plate and retained in the latching mechanism at least in part by the releasable securing of the backing plate to the shell;

wherein the locking plate is moveable in an engaging direction to engage and latch the latch within the latching mechanism and further, wherein the locking plate is moveable in a direction opposite the engaging direction to permit the latch to be delatched from the latching mechanism;

whereby the delatching of the latch from the latching mechanism permits at least the first end of the first arm to be moved in a direction away from the shell.

12. The latching mechanism as claimed in claim 11, wherein the latch comprises a shaft and a head, and wherein the head has a greater width than the shaft; and wherein the locking plate includes an aperture sized to permit the head of the latch to pass therethrough, the locking plate further comprising a finger for engaging the head of the latch when the head of the latch is passed through the aperture in the locking plate.

13. The latching mechanism as claimed in claim 12, wherein the locking plate is rotatably mounted and biased relative to the backing plate; and wherein when the locking plate rotates in the direction opposite the engaging direction, the head of the latch is passable by the finger and when the locking plate rotates back in the engaging direction, the finger engages the head of the latch thereby latching the latch in the latching mechanism.

14. The latching mechanism as claimed in claim 13, further comprising a spring to bias the locking plate relative to the backing plate;

wherein the spring exerts a spring force upon the locking plate so as to bias the locking plate in the engaging direction.

15. The latching mechanism as claimed in claim 14, wherein the locking plate comprises:

a second aperture therethrough; and a tab proximate an edge of the second aperture; and the backing plate comprises a tab extending through the second aperture;

wherein the spring is disposed intermediate the tab of the backing plate and the tab of the locking plate so as to bias the locking plate in the engaging direction.

16. The latching mechanism as claimed in claim 1, wherein the backing plate comprises:

a first end for retaining a first spring bar and a second end for retaining a second spring bar, the backing plate being coupled to the shell by the securing of the first and second spring bars in apertures of the shell; and the locking plate being positioned intermediate the backing plate and the internal cavity of the shell.

17. A buckle for a watchband, the buckle comprising:

a first arm having a first end and a second end, a second arm having a first end and a second end, wherein the first end of the second arm is hingedly coupled to the second end of the first arm, the second arm further having an aperture sized to permit a latch to pass therethrough when the first arm is rotated into a surface-to-surface alignment with the second arm;

a shell, the shell being hingedly coupled to the second end of the second arm; and a latching mechanism, coupled to the shell, wherein the latching mechanism comprises:

a latch extending from a surface of the first arm;

a backing plate releasably securable to the shell, having an aperture sized to permit the latch to pass therethrough;

a locking plate for engaging and latching the latch when the latch is passed through the aperture in the backing plate, the locking plate positioned intermediate an inner cavity of the shell and the backing plate and retained in the latching mechanism at least in part by the releasable securing of the backing plate to the shell;

wherein the locking plate is moveable in an engaging direction to engage and latch the latch within the latching mechanism and further, wherein the locking plate is moveable in a direction opposite the engaging direction to permit the latch to be delatched from the latching mechanism;

whereby the delatching of the latch from the latching mechanism permits at least the first end of the first arm to be moved in a direction away from the shell.

18. A buckle for a watchband, the buckle comprising:

a first arm having a first end and a second end, wherein the first end of the first arm is hingedly coupleable to first watchband portion; and a latch, the latch extending from a surface of the first arm;

a second arm having a first end and a second end, wherein the first end of the second arm is hingedly coupled to the second end of the first arm, the second arm further having an aperture sized to permit the latch to pass therethrough when the first arm is rotated into a surface-to-surface alignment with the second arm;

a shell, the shell being hingedly coupled to the second end of the second arm and hingedly coupleable to a second watchband portion; and a latching mechanism, coupled to the shell, wherein the latching mechanism comprises:

a backing plate releasably securable to the shell, having an aperture sized to permit the latch to pass therethrough;

means intermediate an inner cavity of the shell and the backing plate, for engaging and latching the latch when the latch is passed through the aperture in the backing plate, wherein the means is moveable in a engaging direction to engage and latch the latch within the latching mechanism and further moveable in a direction opposite the engaging direction to permit the latch to be delatched from the latching mechanism;

whereby the delatching of the latch from the locking mechanism permits at least the first end of the first arm to be moved in a direction away from the shell.

19. The buckle as claimed in claim 18, wherein the means is intermediate the backing plate and an internal cavity of the shell and wherein the means is retained intermediate the backing plate and the internal cavity of the shell at least in part by the backing plate.

20. The buckle as claimed in claim 19, wherein the backing plate comprises:

a first end for retaining a first spring bar and a second end for retaining a second spring bar;

wherein the backing plate is releasably secured to the shell by the securing of the first and second spring bars in apertures of the shell.

21. A wristwatch comprising:

a watchhead having a first end and a second end;

a first strap portion having a first end and a second end, wherein the first end of the first strap portion is coupled to the second end of the watchhead;

a second strap portion having a first end and a second end, wherein the second end of the second strap portion is coupled to the first end of the watchhead;

a first arm having a first end and a second end, wherein the first end of the first arm is coupled second end of the first strap portion;

a second arm having a first end and a second end, wherein the first end of the second arm is coupled to the second end of the first arm, the second arm further having an aperture sized to permit a latch to pass therethrough when the first arm is rotated into a surface-to-surface alignment with the second arm;

a shell, the shell being coupled to the second end of the second arm and to the first end of the second strap portion; and a latching mechanism, coupled to the shell, wherein the latching mechanism comprises:

a latch extending from a surface of the first arm;

a backing plate releasably securable to the shell, having an aperture sized to permit the latch to pass therethrough;

a locking plate, positioned intermediate the backing plate and the internal cavity of the shell, for engaging and latching the latch when the latch is passed through the aperture in the backing plate;

wherein the locking plate is moveable in an engaging direction to engage and latch the latch within the latching mechanism and further, wherein the locking plate is moveable in a direction opposite the engaging direction to permit the latch to be delatched from the latching mechanism;

whereby the delatching of the latch from the latching mechanism permits at least the first end of the first arm to be moved in a direction away from the shell.

22. The wristwatch as claimed in claim 21, wherein the first end of the first strap portion is hingedly coupled to the second end of the watchhead; the second end of the second strap portion is hingedly coupled to the first end of the watchhead; the first end of the first arm is hingedly coupled second end of the first strap portion; the first end of the second arm is hingedly coupled to the second end of the first arm; and the shell is hingedly coupled to the second end of the second arm and hingedly coupled to the first end of the second strap portion.

23. The buckle as claimed in claim 21, wherein the locking plate is intermediate the backing plate and an internal cavity of the shell and wherein the locking plate is retained intermediate the backing plate and the internal cavity of the shell at least in part by the backing plate.

24. The buckle as claimed in claim 7 wherein the backing plate comprises:

a first end for retaining a first spring bar and a second end for retaining a second spring bar;

wherein the backing plate is releasably secured to the shell by the securing of the first and second spring bars in apertures of the shell.

* * * * *